US009744554B2

(12) United States Patent
Kim

(10) Patent No.: US 9,744,554 B2
(45) Date of Patent: Aug. 29, 2017

(54) NOZZLE FOR SILICON CONTAINER

(71) Applicant: Sunhee Kim, Changwon-si (KR)

(72) Inventor: Sunhee Kim, Changwon-si (KR)

( * ) Notice: Subject to any disclaimer, the term of this patent is extended or adjusted under 35 U.S.C. 154(b) by 0 days.

(21) Appl. No.: 14/786,765

(22) PCT Filed: May 8, 2015

(86) PCT No.: PCT/KR2015/004594

§ 371 (c)(1),
(2) Date: Oct. 23, 2015

(87) PCT Pub. No.: WO2015/174687

PCT Pub. Date: Nov. 19, 2015

(65) Prior Publication Data

US 2016/0167081 A1 Jun. 16, 2016

(30) Foreign Application Priority Data

May 12, 2014 (KR) ..... 10-2014-0056637

(51) Int. Cl.
*B05C 17/005* (2006.01)
*B05B 15/04* (2006.01)

(52) U.S. Cl.
CPC ..... *B05C 17/00503* (2013.01); *B05B 15/04* (2013.01); *B05C 17/0052* (2013.01); *B05C 17/00516* (2013.01)

(58) Field of Classification Search
CPC . B05B 15/04; B05C 17/005; B05C 17/00503; B05C 17/0052; B05C 5/02
See application file for complete search history.

(56) References Cited

U.S. PATENT DOCUMENTS 1,126,253 A * 1/1915 Morris ..... E04F 21/165 156/305
2,832,086 A * 4/1958 Wells ..... A47L 1/08 15/245

(Continued)

FOREIGN PATENT DOCUMENTS

JP 2005-349275 A 12/2005
JP 2009-195859 A 9/2009

(Continued)

*Primary Examiner* — Frederick C Nicolas
*Assistant Examiner* — Bob Zadeh
(74) *Attorney, Agent, or Firm* — Paratus Law Group, PLLC

(57) ABSTRACT

Disclosed herein is a nozzle for a silicon container, in which scrapers are horizontally and perpendicularly provided at the front end of the nozzle, thereby preventing silicon from unintentionally spreading during the application of silicon. The nozzle for a silicon container includes: a nozzle body configured to provide a discharge path for silicon discharged from a nozzle container; and a horizontal scraper disposed on the nozzle body, and configured to prevent silicon, discharged from the nozzle body, from unintentionally spreading; wherein the horizontal scraper is horizontally disposed along a longitudinal direction of the nozzle body, and is formed to protrude to left, right, and front sides of the nozzle body. The present invention has advantages in that the waste of silicon is prevented and also work efficiency is improved.

3 Claims, 4 Drawing Sheets

(56) References Cited

U.S. PATENT DOCUMENTS

| | | | | | |
|---|---|---|---|---|---|
| 3,584,965 | A * | 6/1971 | Chastanier | A47L 1/08 | 392/396 |
| 4,570,834 | A * | 2/1986 | Ward | B05C 17/00516 | 222/566 |
| 5,017,113 | A * | 5/1991 | Heaton | B05C 17/00516 | 222/327 |
| D338,298 | S * | 8/1993 | Grim, Sr. | D32/45 | |
| 5,588,560 | A * | 12/1996 | Benedict | B65D 35/38 | 222/106 |
| 6,450,723 | B1 * | 9/2002 | Lithgow | B05C 17/00516 | 222/566 |
| 8,764,334 | B1 * | 7/2014 | Buckner | A47L 13/03 | 401/25 |
| 9,120,203 | B2 * | 9/2015 | Kountotsis | B24C 1/086 | |
| 2016/0167081 | A1 * | 6/2016 | Kim | B05C 5/02 | 222/566 |
| 2016/0184860 | A1 * | 6/2016 | Evans | B05D 5/005 | 427/207.1 |

FOREIGN PATENT DOCUMENTS

| | | | |
|---|---|---|---|
| KR | 20-0434064 | Y1 | 12/2006 |
| KR | 20-0449598 | Y1 | 7/2010 |
| KR | 10-1178376 | B1 | 8/2012 |

* cited by examiner

NOZZLE FOR SILICON CONTAINER

CROSS REFERENCE TO PRIOR APPLICATION

This application is a National Stage Patent Application of PCT International Patent Application No. PCT/KR2015/004594 (filed on May 8, 2015) under 35 U.S.C. §371, which claims priority to Korean Patent Application No. 10-2014-0056637 (filed on May 12, 2014), which are all hereby incorporated by reference in their entirety.

BACKGROUND

1. Technical Field

The present invention relates generally to a nozzle for a silicon container, and more particularly to a nozzle for a silicon container, in which scrapers are horizontally and perpendicularly provided at the front end of the nozzle, thereby preventing silicon from unintentionally spreading during the application of silicon.

2. Description of the Related Art

In general, silicon is used to fill gaps or fasten window frames for the purpose of finishing in various types of construction or interior work.

Furthermore, such silicon is contained in a silicon container, and the silicon container is used in the state of being mounted on a silicon gun. Accordingly, when a user pulls the trigger of the silicon gun, the silicon contained in the silicon container is discharged to the outside through a nozzle, and is then used.

Improved technologies for improving the conventional silicon container and silicon nozzle are disclosed in Korean Registered Utility Model No. 20-0449598 and Korean Patent No. 10-1178376.

However, these improved technologies also have a problem in that silicon spreads unintentionally during the application of the silicon. That is, in the technology disclosed in Korean Patent No. 10-1178376, although silicon can be prevented from unintentionally spreading because a nozzle is provided with a blade, the left and right sides of the blade are inclined, and thus a problem arises in that silicon is rather insufficient. Furthermore, another problem arises in that silicon spreads unintentionally to the front side of the nozzle because there is no blade on the front side.

SUMMARY

Accordingly, an object of the present invention is to overcome the above-described problems of the conventional technology, and is to provide a nozzle for a silicon container, in which a scraper is formed across the left, right, and front sides of a nozzle 의 scraper, thereby enabling silicon to be smoothly applied and also preventing silicon from unintentionally spreading.

Another object of the present invention is to provide a nozzle for a silicon container, in which a vertical scraper is provided in addition to a horizontal scraper, thereby completely preventing silicon from being wasted.

In accordance with an aspect of the present invention, there is provided a nozzle for a silicon container, including: a nozzle body configured to provide a discharge path for silicon discharged from a nozzle container; and a horizontal scraper disposed on the nozzle body, and configured to prevent silicon, discharged from the nozzle body, from unintentionally spreading; wherein the horizontal scraper is horizontally disposed along the longitudinal direction of the nozzle body, and is formed to protrude to the left, right, and front sides of the nozzle body.

The horizontal scraper may be configured such that the lateral width thereof gradually decreases in a forward direction and a front end thereof is formed to be rounded, thereby forming a streamlined shape.

The nozzle body may include a cylindrical portion formed in a cylindrical shape, and a tapered portion formed in a truncated cone shape whose diameter decreases in a forward direction; and the horizontal scraper may be formed across the left, right, and front sides of the tapered portion.

The nozzle may further include a vertical scraper formed at the front end of the nozzle body perpendicularly with the horizontal scraper.

The vertical scraper may be formed in a semicircular shape.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Nozzles for a silicon container according to preferred embodiments of the present invention will be described in detail with reference to the accompanying diagrams.

Figure 1:
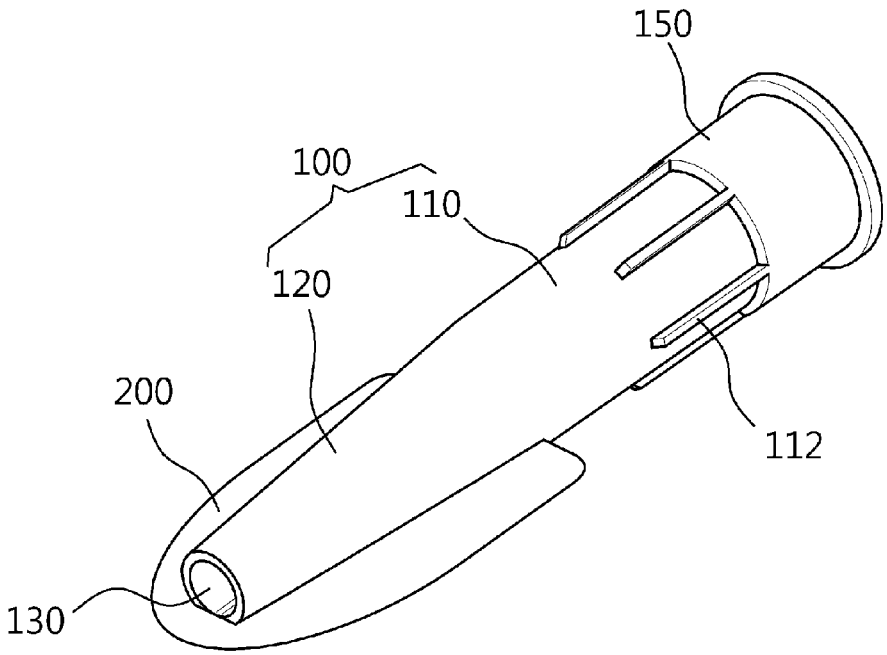
FIG. 1 is a perspective view showing the configuration of the nozzle for a silicon container according to the embodiment the present invention.
Figure 2:
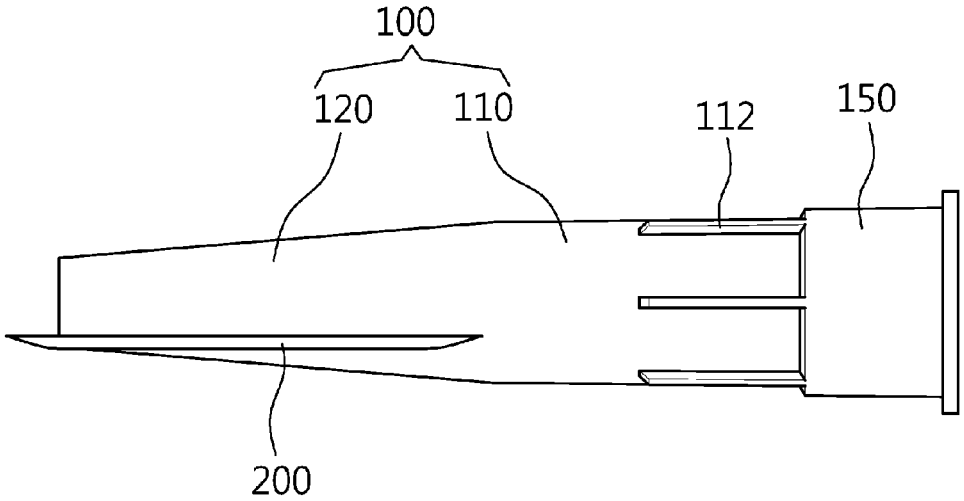
FIG. 2 is a right side view of the nozzle for a silicon container shown in FIG. 1.
Figure 3:
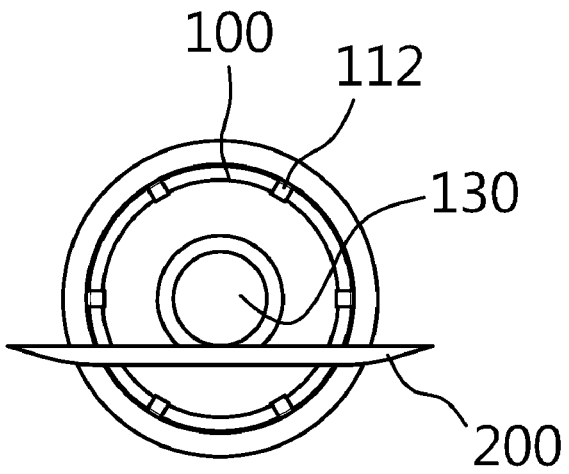
FIG. 3 is a front view of the nozzle for a silicon container shown in FIG. 1.

FIGS. 1 to 3 show the configuration of filleting attachment such as a nozzle for a silicon container according to an embodiment the present invention. That is, FIG. 1 is a perspective view of the nozzle for a silicon container according to the present embodiment, and FIGS. 2 and 3 are right side and front views of the nozzle for a silicon container according to the present embodiment, respectively.

As shown in the drawings, the nozzle for a silicon container according to the present embodiment: includes a nozzle body 100 configured to provide a discharge path for silicon discharged from the nozzle container; and a horizontal scraper 200 disposed on the nozzle body 100, and configured to prevent silicon, discharged from the nozzle body 100, from unintentionally spreading.

The nozzle body 100 is a component that is coupled with a silicon container (not shown). Strictly speaking, the nozzle body 100 functions as a path through which silicon flows. A coupling portion 150 that is coupled with the silicon container is further provided at the rear end of the nozzle body 100.

The coupling portion 150 is formed to have an outer diameter larger than the outer diameter of the nozzle body 100, as shown in the drawings. A female screw (not shown) is formed in the inner surface of the coupling portion 150, and is engaged with the male screw (not shown) part of the silicon container.

The nozzle body 100 includes a cylindrical portion 110 formed in a cylindrical shape, and a tapered portion 120 formed in a truncated cone shape whose diameter decreases in a forward direction.

The cylindrical portion 110 forms the rear half portion of the nozzle body 100, as shown in the drawings. A hole through which silicon entering from the back thereof flows is formed through the inside of the cylindrical portion 110.

The tapered portion 120 is integrated with the cylindrical portion 110 in front of the cylindrical portion 110, and has a tapered shape whose outer diameter decreases in a forward direction. Furthermore, a hole that communicates with the inside of the cylindrical portion 110 is formed inside the tapered portion 120, and guides silicon through its movement.

An outlet 130 is formed at the front end of the tapered portion 120, as shown in the drawing. The outlet 130 is an exit through which silicon that has passed though the inside of the nozzle body 100 is discharged.

Meanwhile, a plurality of ribs 112 adapted to enhance strength is further formed on the cylindrical portion 110. That is, the plurality of ribs 112 is formed on the outside surface of the cylindrical portion 110 at regular intervals. These ribs 112 function to enhance the strength of the nozzle body 100.

The horizontal scraper 200 is horizontally disposed along the longitudinal direction of the nozzle body 100, and is formed to protrude to the left, right, and front sides of the nozzle body 100.

The horizontal scraper 200 is formed across the left, right, and front sides of the nozzle body 100, and is configured such that the width of the horizontal scraper 200 in a lateral direction gradually decreases in a forward direction. Furthermore, the horizontal scraper 200 is formed to have a rounded front end, and thus forms a streamlined shape.

The reason why the horizontal scraper 200 is formed in a streamlined shape is to, when filling the gaps of a window frame with silicon, enable the horizontal scraper 200 to be flexibly bent due to its elasticity and also ensure spaces, which are filled with silicon, at the corners of the window frame. For example, if the front end of the horizontal scraper 200 is formed in a triangular shape, silicon with which a corner of a window frame has been filled may be scraped off the corner by the horizontal scraper 200 because the corner of the window frame forms a right angle.

More specifically, the horizontal scraper 200 is formed across the left, right, and front sides of the tapered portion 120. That is, the rear end of the horizontal scraper 200 is made to coincide with the rear end of the tapered portion 120, and the rear end of the horizontal scraper 200 protrudes to the front side of the tapered portion 120 to a predetermined extent.

Furthermore, it is preferred that the horizontal scraper 200 be made of flexible material. That is, it is preferred that the horizontal scraper 200 be made of elastic material and thus be easily pushed and bent by a surface of a building during the application of silicon.

Furthermore, the horizontal scraper 200 may be made of the same material as the nozzle body 100. In this case, it is preferred that the horizontal scraper 200 and the nozzle body 100 be simultaneously formed by injection molding in an integrated manner.

The horizontal scraper 200 is formed in the lower half portion of the nozzle body 100, as shown in the drawings.

More specifically, the horizontal scraper 200 is formed at the same height as the bottom of the front end of the tapered portion 120. That is, the horizontal scraper 200 is formed to have the same thickness as the front end of the tapered portion 120, and is formed to be flush with the lower end of the outlet 130 formed at the front end of the tapered portion 120.

Furthermore, the edge of the horizontal scraper 200 is formed to be sharp. That is, as shown in the drawings, the edge of the horizontal scraper 200 is formed to become thinner in an outward direction, and thus the outside end of the horizontal scraper 200 becomes sharp. This enables the edge of the horizontal scraper 200 to be easily bent, and thus allows the application of silicon to be smoothly performed even when the corners of a building are varied.

Figure 4:
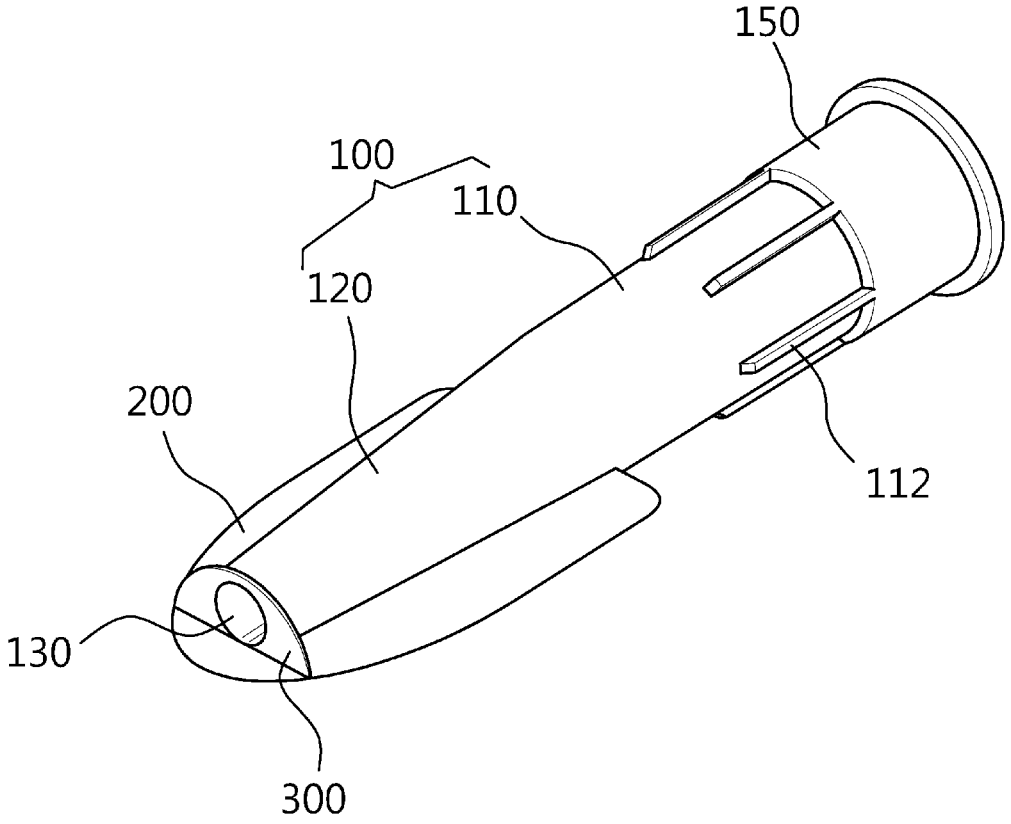
FIG. 4 is a perspective view showing the configuration of a nozzle for a silicon container according to another embodiment of the present invention.
Figure 5:
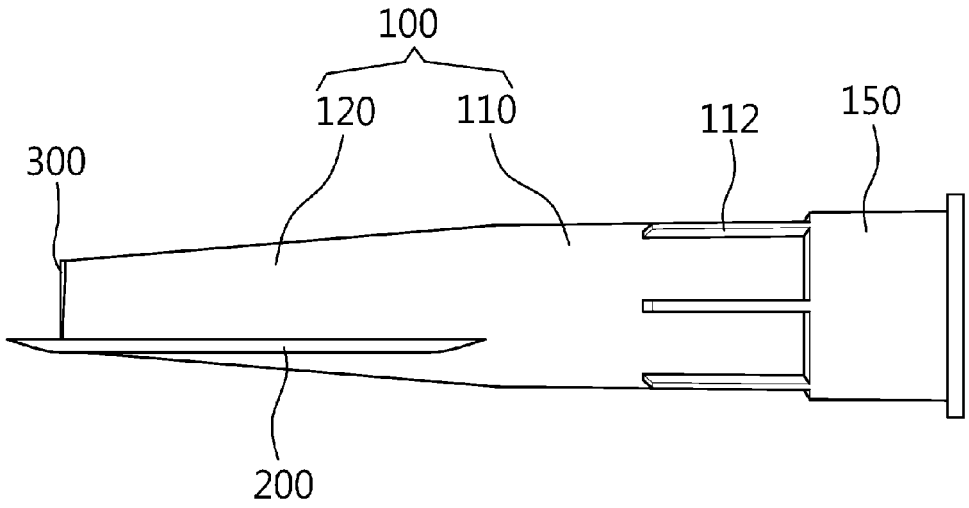
FIG. 5 is a right side view of the nozzle for a silicon container shown in FIG. 4.
Figure 6:
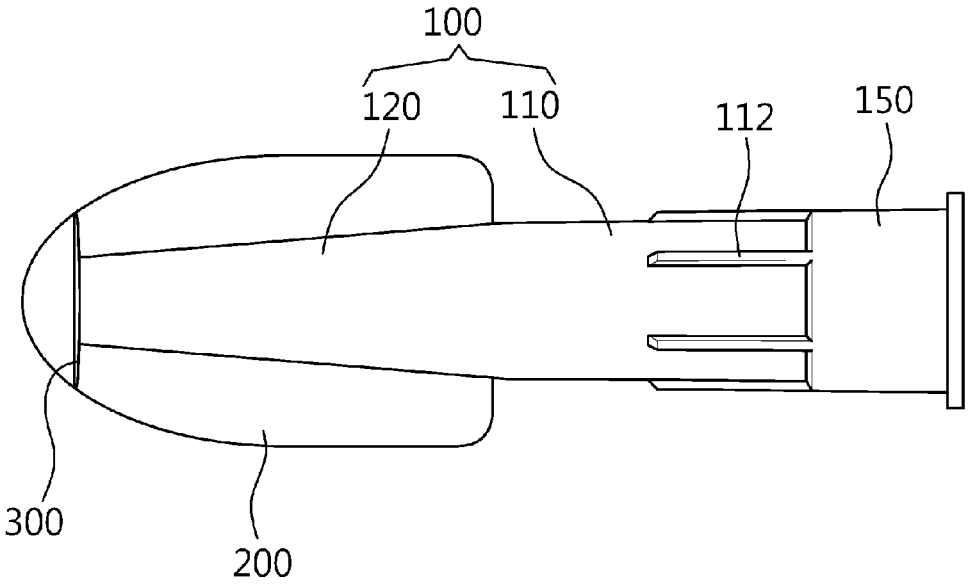
FIG. 6 is a plan view of the nozzle for a silicon container shown in FIG. 4.
Figure 7:
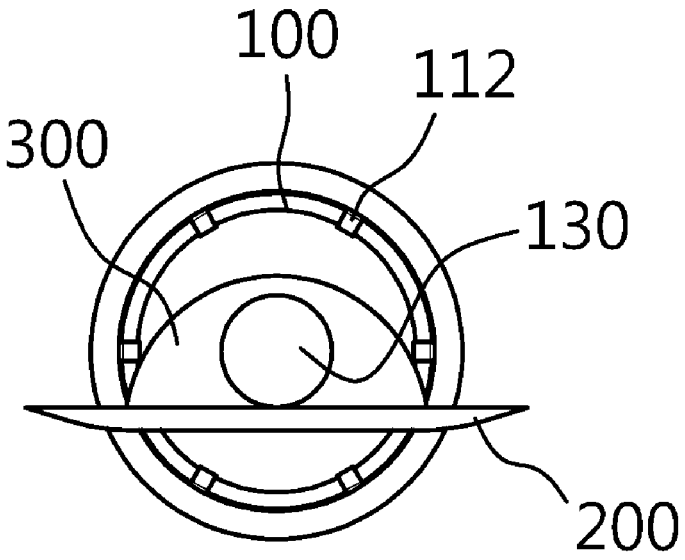
FIG. 7 is a front view of the nozzle for a silicon container shown in FIG. 4.

FIGS. 4 to 7 show the configuration of a nozzle for a silicon container according to another embodiment of the present invention. That is, FIG. 4 is a perspective view showing the configuration of the nozzle for a silicon container according to the present embodiment, and FIGS. 5 to 7 are a right side view, a plan view and a front view of the nozzle for a silicon container according to the present embodiment.

As shown in these drawings, in the present embodiment, a vertical scraper 300 is added to the former embodiment described above. That is, the vertical scraper 300 perpendicular to the horizontal scraper 200 is further formed at the front end of the nozzle body 100.

Furthermore, the vertical scraper 300 is formed in a semicircular shape, and is made of the same flexible material as the horizontal scraper 200.

More specifically, the vertical scraper 300 is vertically formed at the front end of the tapered portion 120, and the height of the vertical scraper 300 is formed not to exceed the upper end of the tapered portion 120.

Furthermore, the vertical scraper 300 is formed in a semicircular shape. Both side ends of the vertical scraper 300 are made to coincide with both side ends of the horizontal scraper 200. That is, the lateral width of the vertical scraper 300 is formed not to exceed the lateral width of the horizontal scraper 200.

The reason for this is that the main purpose of the vertical scraper 300 is to prevent silicon, discharged to the outside of the nozzle body 100 through the outlet 130, from flowing through the sides and then being pushed backward. That is, when the size of the vertical scraper 300 is excessively large, the application of silicon may not be smoothly performed, and thus may be interrupted.

Meanwhile, it is preferred that the thickness of the edge of the vertical scraper 300 be smaller than that of the center portion thereof like that of the horizontal scraper 200. The reason for this is to enable the vertical scraper 300 to be easily bent when it comes into contact with a building or window frame, thereby allowing the application of silicon to be smoothly performed, as described above.

The operations of the nozzles for a silicon container having the above-described configurations are described with reference to FIGS. 1 to 7.

First, the coupling portion 150 of the nozzle body 100 is coupled with a silicon container (not shown). Thereafter, when a silicon gun is pulled, silicon contained in the silicon container is guided through the nozzle body 100 and then discharged through the outlet 130.

In this case, an operator moves the nozzle in a single direction while maintaining the horizontal scraper 200 in contact with a corner of a building or window frame. By doing so, silicon discharged through the outlet 130 enters into a gap of the building or the corner of the building, and the silicon leaving the outlet 130 is prevented from being unintentionally spread to a surrounding area by the horizontal scraper 200.

It will be apparent that when an operator applies silicon, he or she commonly does it in the state of tilting the nozzle body 100 forward rather than in the state of keeping the nozzle body 100 perpendicular to the wall surface of a building or a window frame.

Meanwhile, when the vertical scraper 300 is provided, silicon discharged through the outlet 130 is blocked by the vertical scraper 300, and thus is prevented from being pushed to the rear side of the nozzle body 100.

The scope of the present invention is not limited to the illustrated embodiments, and many modifications based on the present invention will be apparent to those skilled in the art within the above-described technical range.

For example, although the case where the nozzle body 100, the horizontal scraper 200 and the vertical scraper 300 are made of the same material has been described as an example, these components may be made of respectively different materials and coupled with one another.

The nozzle for a silicon container according to the present invention has the following advantages:

According to the present invention, the horizontal scraper is formed across the left, right, and front sides of the nozzle horizontally with the nozzle. Accordingly, silicon is sufficiently discharged to a corner of a building and also is prevented from being pushed through the left and right sides of the nozzle, and thus advantages arise in that silicon is prevented from being wasted and also the application of silicon is completed by a single operation, thereby improving work efficiency.

Furthermore, according to the present invention, in addition to the horizontal scraper, the vertical scraper is provided at the front end of the nozzle. Accordingly, silicon is prevented from overflowing even when the amount of silicon discharged is large, and thus an advantage arises in that the effective application of silicon can be performed.

According to the present invention, the scraper is provided, and thus there is no need to trim silicon, discharged from the silicon container, using a separate scraper. Accordingly, since the application and trimming of silicon can be completed by a single operation, the waste of silicon can be prevented and also work efficiency can be improved.

Although the specific embodiments of the present invention have been disclosed for illustrative purposes, those skilled in the art will appreciate that various modifications, additions and substitutions are possible without departing from the scope and spirit of the invention as disclosed in the accompanying claims.

What is claimed is:

1. A filleting attachment for extruding sealant, comprising:

a tubular body including a first end having an inlet, and a second end opposite to the first end and having an outlet being in fluid communication with the inlet;

a horizontal scraper extended from an outer surface of the tubular body at the second end toward front, rear, left, and right sides of the tubular body, and disposed perpendicularly to the outlet; and a vertical scraper formed at the second end around the outlet in a semicircular shape, disposed perpendicularly to the horizontal scraper, and having a rounded top which does not protrude outwardly from a top portion of the second end of the tubular body and a planar bottom opposite to the rounded top and connected with the horizontal scraper.

2. The filleting attachment of claim 1, wherein the horizontal scraper is configured such that a lateral width thereof gradually decreases in a forward direction and a front end thereof is formed to be rounded, thereby forming a streamlined shape.

3. The filleting attachment of claim 2, wherein:

the tubular body comprises a cylindrical portion formed in a cylindrical shape at the first end, and a tapered portion formed in a truncated cone shape whose diameter decreases in a forward direction at the second end; and the horizontal scraper is formed across the tapered portion.

* * * * *